US007147405B2

(12) United States Patent
Ferraiolo

(10) Patent No.: US 7,147,405 B2
(45) Date of Patent: Dec. 12, 2006

(54) ELEMENT FOR FORMING GROUND COVERING, RESTRAINING AND REINFORCING STRUCTURES

(75) Inventor: Francesco Ferraiolo, Ca' de' Fabbri (IT)

(73) Assignee: Officine Maccaferri S.p.A., Bologna (IT)

( * ) Notice: Subject to any disclaimer, the term of this patent is extended or adjusted under 35 U.S.C. 154(b) by 0 days.

(21) Appl. No.: 10/526,236

(22) PCT Filed: Sep. 18, 2003

(86) PCT No.: PCT/IB03/04139

§ 371 (c)(1),
(2), (4) Date: Feb. 28, 2005

(87) PCT Pub. No.: WO2004/027161

PCT Pub. Date: Apr. 1, 2004

(65) Prior Publication Data

US 2005/0271478 A1 Dec. 8, 2005

(30) Foreign Application Priority Data

Sep. 19, 2002 (IT) ..... BO02A0596

(51) Int. Cl.
*E02D 29/02* (2006.01)

(52) U.S. Cl. ..... 405/284; 405/262

(58) Field of Classification Search ..... 405/284–287, 405/262, 302.7

See application file for complete search history.

(56) References Cited

U.S. PATENT DOCUMENTS 4,117,686 A * 10/1978 Hilfiker ..... 405/284
4,505,621 A * 3/1985 Hilfiker et al. ..... 405/284
5,076,735 A * 12/1991 Hilfiker ..... 405/284
5,156,496 A * 10/1992 Vidal et al. ..... 405/302.7
5,531,547 A * 7/1996 Shimada ..... 405/262
6,296,422 B1 * 10/2001 Ferraiolo ..... 405/262
6,345,934 B1 * 2/2002 Jailloux et al. ..... 405/262
6,764,252 B1 * 7/2004 Banting ..... 405/262
6,857,823 B1 * 2/2005 Hilfiker et al. ..... 405/285

FOREIGN PATENT DOCUMENTS

| | | | |
|---|---|---|---|
| DE | 44 09 538 A1 | | 2/1995 |
| EP | 0 197 000 A1 | | 10/1986 |
| JP | 11036313 | * | 2/1999 |
| WO | WO 96/17134 | | 6/1996 |
| WO | WO 96/33314 | | 10/1996 |
| WO | WO 98/38391 | | 9/1998 |
| WO | WO 00/31350 | | 6/2000 |

OTHER PUBLICATIONS

International Search Report mailed Feb. 12, 2004 in PCT International Application No. PCT/IB03/04139.

* cited by examiner

*Primary Examiner*—Frederick L. Lagman
(74) *Attorney, Agent, or Firm*—Flynn, Thiel, Boutell & Tanis, P.C.

(57) ABSTRACT

An improved element for forming ground covering, restraining and reinforcing structures, comprising a lower wall, an upper wall and a front wall connected in an articulated manner, at one of its end edges at least, to an edge of the lower wall or the upper wall.

22 Claims, 2 Drawing Sheets

ELEMENT FOR FORMING GROUND COVERING, RESTRAINING AND REINFORCING STRUCTURES

The present invention relates to the sector of ground covering, restraining and reinforcing structures, for instance for the stabilisation of slopes, embankments and the like.

The applicants have in the past developed various structures of the type described above which have proved particularly appropriate and effective. For instance, document EP 1012406 in the name of the applicants discloses a structure formed by a framework of wire netting of the double twist type, folded to form a structure with a base wall, a front wall and a rear wall. The front wall of wire netting is reinforced with a further panel of electrically welded wire netting. A geosynthetic layer on the front wall makes it possible to provide "green" walls and can be used for the growth of vegetation which helps to stabilise the slope.

Although the structures described above have demonstrated that they can effectively perform their task of stabilisation, their construction on site requires skilled workers and specific equipment. When stabilising steep slopes, for instance, a scaffolding has to be erected at the front of the works in order to enable access to the structure from the front wall side in order to carry out the manual folding of the wire netting and thus produce the upper wall section. During this folding, moreover, the metal structure of the netting has to be deformed at the fold line, making site installation operations laborious and in some cases not very precise.

The object of the present invention is to resolve the above-mentioned problems by means of an improved element for forming ground covering, restraining and reinforcing structures which can be correctly installed on site in a simple manner, possibly by relatively unskilled workers, and which does not, moreover, require the use of specific equipment or the erection of scaffolding at the front of the works.

A further object of the invention is to provide an improved element which is simple and economic to produce, can be readily transported from factory to site and also has a strength and a reliability at least equivalent to those of the elements of known type.

In order to achieve the above-described objects, the present invention relates to an improved element having the characteristic features set out in the following claims.

Further characteristic features and advantages are set out in the following detailed description of a preferred embodiment, given purely by way of non-limiting example, and made with reference to the accompanying drawings, in which.

Figure 1:
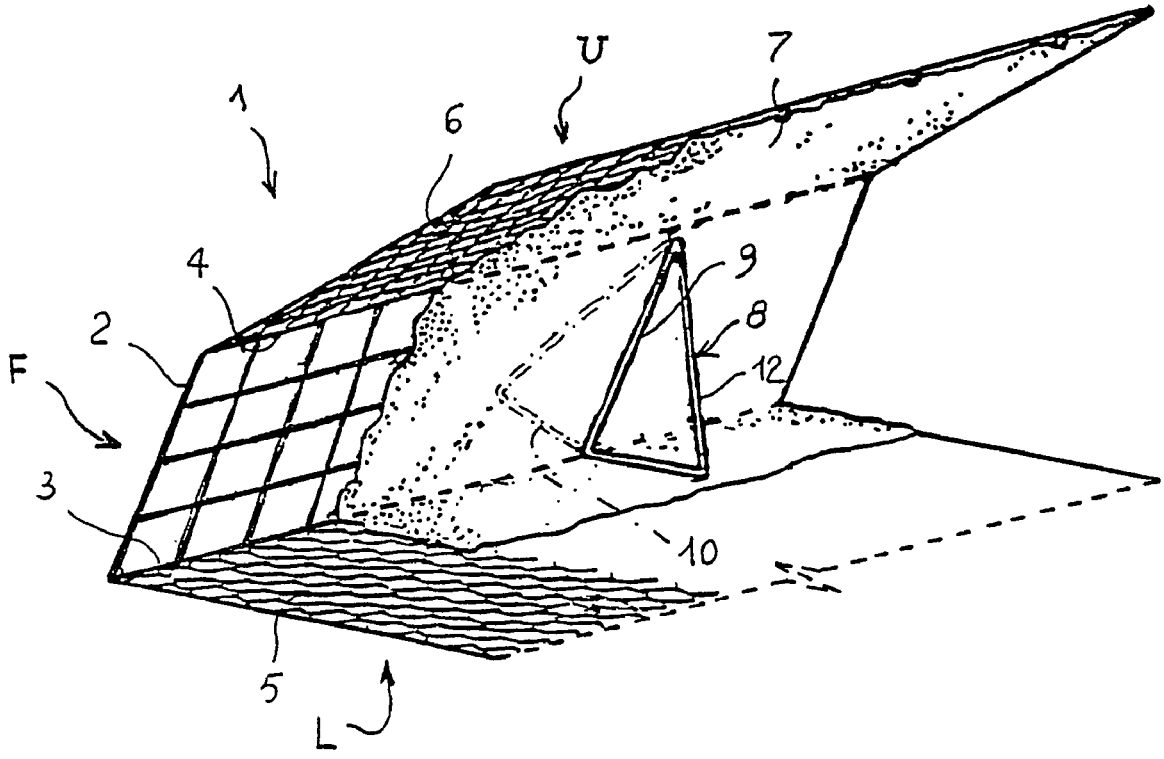
FIG. 1 is a perspective view of an improved element of the present invention, in a ready-for-use configuration.
Figure 7:
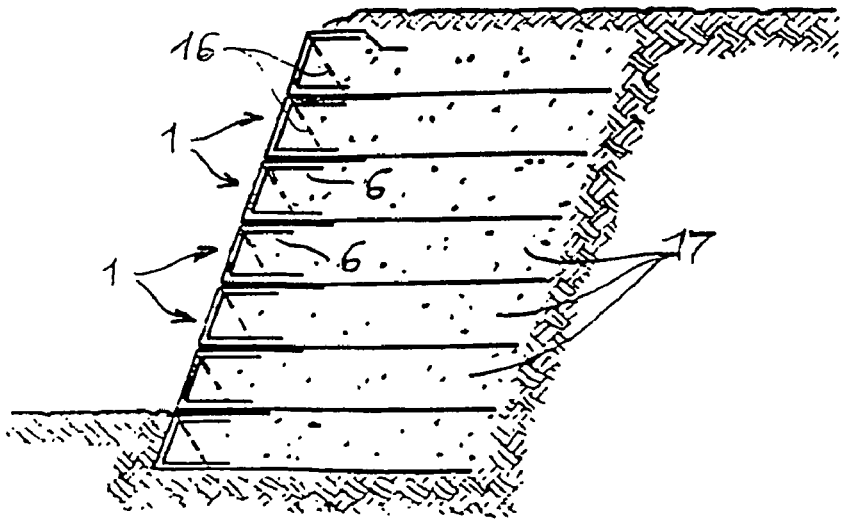
Figure 6:
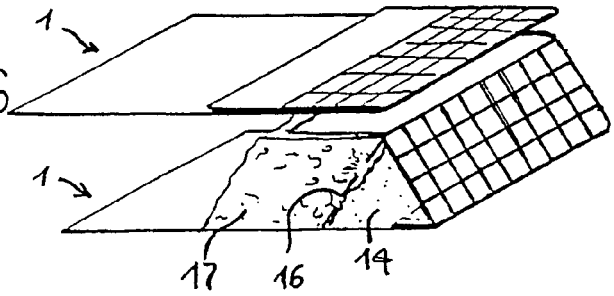
Figure 6A:
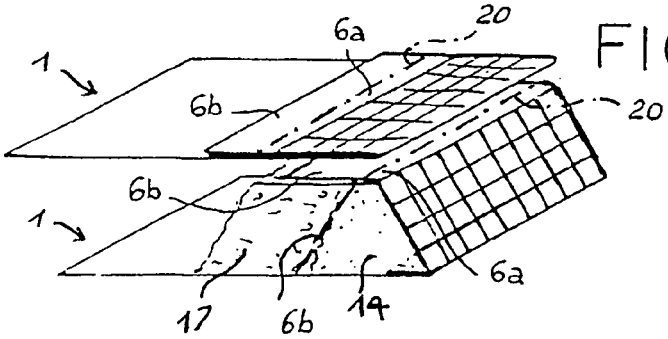

FIG. 6*a* is a variant of the end-use configuration of FIG. 6;

FIG. 7 is a section through a restraining wall or reinforced slope comprising superimposed layers formed by a plurality of elements of FIG. 1.

With reference to FIG. 1, an element 1 for forming ground covering, restraining and reinforcing structures of the present invention comprises a front wall F, a lower wall L and an upper wall U. The front wall F comprises a front panel 2 with two opposite edges 3, 4 connected in an articulated manner to a lower panel 5 of the lower wall L and an upper panel 6 of the upper wall U respectively. The panels are preferably of wire netting and the front panel 2 can in particular be made from electrically welded wire netting, for instance of the square mesh type, while the lower and upper panels 5 and 6 can be made from wire netting preferably, but not exclusively, of the double twist and hexagonal mesh type. The articulated connections between the panels are preferably made at the factory by means of mechanised metal staples, metal ties or other known connection means.

A covering layer 7 of geosynthetic material or bio-matting may be secured where appropriate to the front panel 2 and may be extended to cover all or part of the lower and upper panels 5 and 6 as well. Brackets 8, preferably but not exclusively of triangular shape, are also connected to the front panel 2. The brackets 8 may also be in the form of bars secured or hooked to the front panel 2 and/or the lower panel 5. In the case of the triangular brackets 8 shown in the drawings, only the front side 9 of each bracket is connected in an articulated manner to the front panel 2 so that the brackets 8 may be folded against the front panel 2, as shown by the dot-dash line 10 in FIG. 1, for more convenient transportation of the element 1 in a flat form from the factory to the site.

Figure 2:
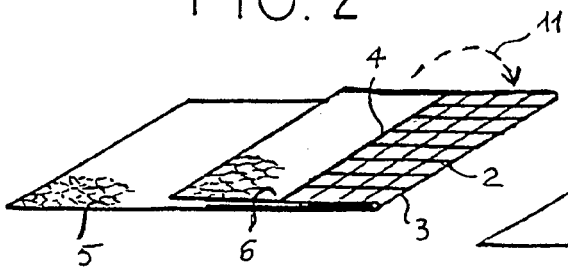
FIGS. 2 to 6 show the successive stages of use of the improved element of FIG. 1.

The preferred configuration for transportation of the element 1 is shown in FIG. 2, in which the front panel 2 and the upper panel 6 are folded onto the lower panel 5 whose dimensions are normally larger. It will be appreciated that, depending on the particular dimensions of the netting panels which form the element 1 and/or the convenience of packaging of the elements 1, as well as the type and dimensions of the vehicles used to transport these elements, that the panels may be folded in an alternative way, for instance in zigzag form, in which the upper panel 6 is placed on the front panel 3 as shown by the dashed arrow 11 of FIG. 2.

Figure 3:
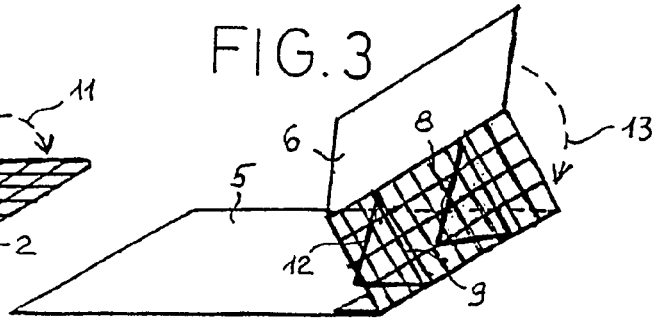

After placing the element 1, and in particular the lower panel 5, on the section of ground to be reinforced, the front panel 2 is raised, as shown in FIG. 3, until it reaches a position inclined to a greater or lesser extent with respect to the lower panel 5. The front panel is held in position by the brackets 8 which are oriented so that the ends of a rear side 12 thereof bear on the lower panel 5 and the front panel 2 respectively. It will be appreciated that this object could be achieved by alternative brackets in the form of simple bars as mentioned above. The upper panel 6 may be held manually in the raised position shown in FIG. 3 or may be placed on the front surface of the front wall 2 by causing it to tilt in the direction of the dashed arrow 13. Obviously, when the element 1 is to be transported to the site in the zigzag folded configuration mentioned above, the upper panel 5 would already be in the above-mentioned position folded on the front surface of the front panel 2.

Figure 4:
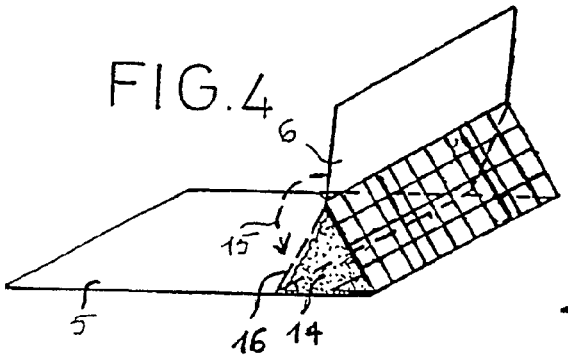
Figure 5:
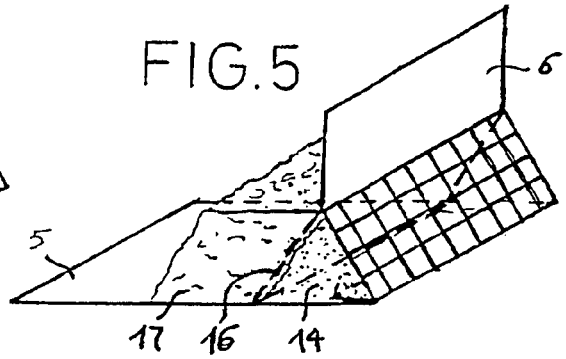

The ground reinforcing operations continue with the provision of a layer of earth, preferably topsoil, at the rear of the front panel 2, as shown in FIG. 4. The layer of earth 14 is preferably arranged so that it has, in cross-section with respect to the layers of panels of the element 1, a substantially triangular profile. If the upper panel 6 is not too high, and in particular substantially corresponds to or is lower than the height of the front panel 2, is it possible to tilt this upper panel 6 in the direction of the dashed arrow 15 of FIG. 4 until it is alongside the rear flank of the layer of earth 14, as shown by reference numeral 16 in FIGS. 5 to 7. As an alternative, it is possible to place the upper panel 6 on a further layer of earth 17, preferably a structural embankment, which is placed alongside, as shown in FIG. 6, the first layer of earth 14 to complete one of the plurality of layers 18 of the reinforcing works shown overall in FIG. 7 and formed by a sequence of superimposed elements 1. In this latter case, the final configuration of the element 1 bears the conventional "C"-shaped configuration, in which the lower and upper panels 5 and 6 are substantially parallel.

Many variants are possible with respect to the preferred embodiment described above. For instance, the front, lower and/or upper walls F, L and U may be made from a plurality of wire netting panels connected to one another rigidly or in an articulated manner. For instance, the upper wall U could be divided into two portions comprising at least two wire netting panels 6*a*, 6*b* connected together and articulated along a common edge 20, shown diagrammatically in dot-dash lines in FIG. 6*a*, substantially parallel to the edges 3, 4 of the front panel 2. This makes it possible to provide the layer of earth 14 with a configuration, in cross-section with respect to the layers of panels of the element 1, with a substantially trapezoidal profile at whose apex the panel 6*a* is placed, while the panel 6*b* is placed on the inclined side opposite to the front wall F so that it can then be incorporated in the earth 17 provided subsequently. Obviously, in the case in which the upper wall U is placed on the earth in a position substantially parallel to the lower wall L, the configuration of the layer of earth 14 may be triangular or trapezoidal.

The embodiments and structural details of the invention may obviously be widely varied from those described and illustrated, without prejudice to the principle of the invention and without thereby departing from the scope of the present invention.

The invention claimed is:

1. An improved element for forming ground covering, restraining and reinforcing structures, said improved element comprising a front wall comprising at least one panel of electrically welded wire netting, a lower wall and an upper wall each comprising at least one panel of double-twist hexagonal-mesh wire netting, the front wall being connected in an articulated manner at one of its end edges at least, to an edge of the lower wall or the upper wall.

2. An improved element as claimed in claim 1, wherein the front wall is connected in an articulated manner at two of its opposite end edges to an edge of the lower wall and an edge of the upper wall respectively.

3. An improved element as claimed in claim 1, wherein the upper wall has a height substantially corresponding to or less than the height of the front wall.

4. An improved element as claimed in claim 1, further comprising bracket means adapted to support, in use, the front wall in an inclined configuration with respect to the lower wall.

5. An improved element as claimed in claim 4, wherein the bracket means comprise at least one triangular bracket with a side secured in an articulated manner to the front wall.

6. An improved element as claimed in claim 1, wherein a layer of geosynthetic material or bio-matting is secured to the front wall.

7. An improved element as claimed in claim 1, wherein the articulated connection of the front wall to the lower wall and/or the upper wall is factory-made, the element being stowed and/or transported to the place of use in a flat configuration in which the front wall is placed on the lower wall and/or the upper wall.

8. An improved element as claimed in claim 7, wherein the front wall is connected in an articulated manner to both the lower wall and the upper wall, the element being stowed and/or transported to the place of use in a flat configuration in which the front wall and the upper wall are both placed on the lower wall.

9. An improved element as claimed in claim 7, wherein the front wall is connected in an articulated manner to both the lower wall and the upper wall, the element being stowed and/or transported to the place of use in a flat configuration in which the front wall, the upper wall and the lower wall are folded and placed at least partially on top of one another in a zigzag configuration.

10. An improved element as claimed in claim 1, wherein the upper wall comprises at least two panels connected to one another in an articulated manner along a common edge substantially parallel to the edges of the front wall.

11. An improved element for forming ground covering, restraining and reinforcing structures, the improved element comprising a front wall, a lower wall and an upper wall, the front wall being connected in an articulated manner at one of its end edges at least, to an edge of the lower wall or the upper wall, wherein the upper wall comprises at least two panels connected to one another in an articulated manner along a common edge substantially parallel to the end edges of the front wall.

12. An improved element according to claim 11, wherein the front wall is connected in an articulated manner at two of its opposite end edges to an edge of the lower wall and an edge of the upper wall respectively.

13. An improved element as claimed in claim 11, wherein the upper wall has a height substantially corresponding to or less than the height of the front wall.

14. An improved element as claimed in claim 11, further comprising bracket means adapted to support, in use, the front wall in an inclined configuration with respect to the lower wall.

15. An improved element as claimed in claim 14, wherein the bracket means comprise at least one triangular bracket with a side secured in an articulated manner to the front wall.

16. An improved element as claimed in claim 11, wherein a layer of geosynthetic material or bio-matting is secured to the front wall.

17. An improved element as claimed in claim 11, wherein the front wall comprises at least one panel of electrically welded wire netting, the lower and upper walls each comprising at least one panel of double-twist hexagonal-mesh wire netting.

18. An arrangement for forming ground covering, restraining and reinforcing structures, said arrangement comprising a front wall including a panel of welded wire netting, a lower wall and an upper wall each including a panel of double-twist hexagonal-mesh wire netting, each said wall defining a pair of spaced-apart side edges and a pair of spaced-apart end edges oriented transversely relative to the respective side edges, said front wall and one of said upper and lower walls being separate components from one another and one of said end edges of said front wall being pre-connected to an adjacent said end edge of said one upper and lower wall to define a freely-articulating joint therebetween, said freely-articulating joint being configured to permit said front wall and said one upper and lower wall to articulate freely relative to one another during installation of said arrangement.

19. The arrangement of claim 18, wherein said front wall and both said upper and lower walls are separate components from one another, said one end edge of said front wall being pre-connected to said end edge of said lower wall to define said freely-articulating joint therebetween, and the other said end edge of said front wall being pre-connected to an adjacent said end edge of said upper wall to define a freely-articulating joint therebetween, said freely-articulating joints being configured to permit free articulation of said front wall and said upper and lower walls relative to one another during installation.

20. The arrangement of claim 18, wherein said freely-articulating joint is configured to permit said front wall and said one upper and lower wall to articulate freely relative to one another during installation of said arrangement without requiring manual deformation of said walls during installation.

21. A method of making and using an arrangement for forming ground covering, restraining and reinforcing structures, said method comprising the steps of:

providing the arrangement with a front wall with a panel of welded wire netting, and lower and upper walls with respective panels of doubletwist hexagonal-mesh wire netting;

connecting, at a place of manufacture of the arrangement, an end edge of the front wall to an end edge of one of the lower and upper walls to define an articulating joint therebetween;

after said step of connecting, transporting the arrangement to a desired site requiring ground covering, restraining or reinforcing; and installing the arrangement at the desired site, and during said step of installing, articulating the front wall and the one upper and lower wall relative to one another at the articulating joint.

22. The method of claim 21, further comprising forming the front wall and the one upper and lower wall as separate components from one another, and said step of articulating does not require deformation of the material of any of the walls.

* * * * *